United States Patent [19]

Loos

[11] Patent Number: 4,655,851

[45] Date of Patent: Apr. 7, 1987

[54] SIMULTANEOUS CARBURIZING AND BORONIZING OF EARTH BORING DRILL BITS

[75] Inventor: Peter J. Loos, Pearland, Tex.

[73] Assignee: Hughes Tool Company-USA, Houston, Tex.

[21] Appl. No.: 743,449

[22] Filed: Jun. 11, 1985

[51] Int. Cl.[4] ..... C21D 1/48; C21D 1/56; C21D 9/22; C23C 9/00

[52] U.S. Cl. ..... 148/6; 148/15.5; 148/16.5

[58] Field of Search ..... 148/6, 15.5, 16.5, 31.5

[56] References Cited

U.S. PATENT DOCUMENTS

| | | | |
|---|---|---|---|
| 3,155,548 | 11/1964 | Ashikari et al. | 148/13.1 |
| 4,188,242 | 2/1980 | Scales | 148/15.5 |
| 4,495,006 | 1/1985 | Aves et al. | 148/6 X |

*Primary Examiner*—Michael R. Lusignan

*Attorney, Agent, or Firm*—Charles D. Gunter, Jr.

[57] ABSTRACT

Disclosed herein are treatments for the manufacture of earth boring drill bits having abrasive wear resistant seal surfaces. The external surface of the bearing pin is surface treated, as by carburizing, in one region and simultaneously boronized over the remaining friction bearing region in a one step operation.

7 Claims, 4 Drawing Figures

SIMULTANEOUS CARBURIZING AND BORONIZING OF EARTH BORING DRILL BITS

BACKGROUND OF THE INVENTION

1. Field of the Invention:

This invention relates in general to surface treatment of metals, and particularly to those for steels requiring wear resistance under heavy loads, such as those imposed upon earth boring drill bit bearings.

2. Description of the Prior Art:

Various treatments are known in the prior art for the surfaces of metals, such as steel, which are used to provide hard, wear resistance surfaces upon the metals so treated. One prior art treatment technique is carburization. Another prior art treatment is boronizing.

The bearing surfaces of rotatable cutters in earth boring drill bits are commonly carburized, hardened and tempered to increase their wear resistance. Such surfaces sometimes have regions of soft, anti-galling material such as silver or silver alloy, as disclosed in U.S. Pat. No. 3,235,316. The mating surfaces of the opposing bearing shafts often include deposits of cobalt based hard metal alloy of the "Stellite" series.

U.S. Pat. No. 4,188,242 teaches a process for carburizing and then boronizing the bearing surface of a rotatable cutter in an earth boring drill bit. In the '242 patent, the metal bearing surface was carburized and then the same metal surface was boronized. The metal surface was then hardened in a manner to produce a martensitic grain structure in the carburized case, and tempered to produce tempered martensite, with the result being a surface of extreme hardness.

Despite these advantages, the carburizing step is expensive and adds to manufacturing cost. Additionally, the only region of the head section of a drill bit which requires carburization is the sealing surface around the circumference of the bearing pin near its base. This location must be made resistant to the abrasive wear caused by the O-ring seal on the sealing surface.

The present invention is directed to a simultaneous carburizing and boronizing method, in which only the seal region of the bearing pin is carburized, and in which the remaining area of the bearing pin is boronized simultaneously. The simultaneous carburizing and boronizing method improves bearing performance under severe conditions. The method can also considerably reduce manufacturing costs.

SUMMARY OF THE INVENTION

This invention relates to the discovery that a wear resistant surface for steel, such as a bearing surface in an earth boring drill bit, may be constructed advantageously by a process that includes a surface hardening treatment, such as a carburizing treatment on the seal region of the bearing pin while simultaneously boronizing the remaining area of the pin. The pin can then be hardened and tempered to provide a wear resistant surface suitable for bearing heavy loads, such as are encountered during earth boring operations.

The simultaneous treatments of sealing surface and the remainder of the load bearing surface are carried out on an earth boring drill bit of the type having a bearing pin extending from a head section of the drill bit for rotatably mounting a cutter. The bearing pin has a seal region adjacent the base thereof and a primary friction bearing region which extends outwardly therefrom. A container is placed over a portion of the head section so that the pin extends within the interior of the container. A solid surface treatment mixture, such as a pack carburizing mixture, is placed into the container to a depth sufficient to cover the seal region of the pin. The container is then divided into two compartments by placing a partition into the container interior on top of the carburizing mixture. A boronizing mixture is then placed into the container to a depth sufficient to cover the primary friction bearing region of the pin. The container is then covered and the pin and the container are placed into a furnace for a time and at a temperature to produce a pin having a carburized seal region and a boronized friction bearing region.

Additional objects, features and advantages will be apparent in the written description which follows.

DETAILED DESCRIPTION OF THE INVENTION

Figure 1:
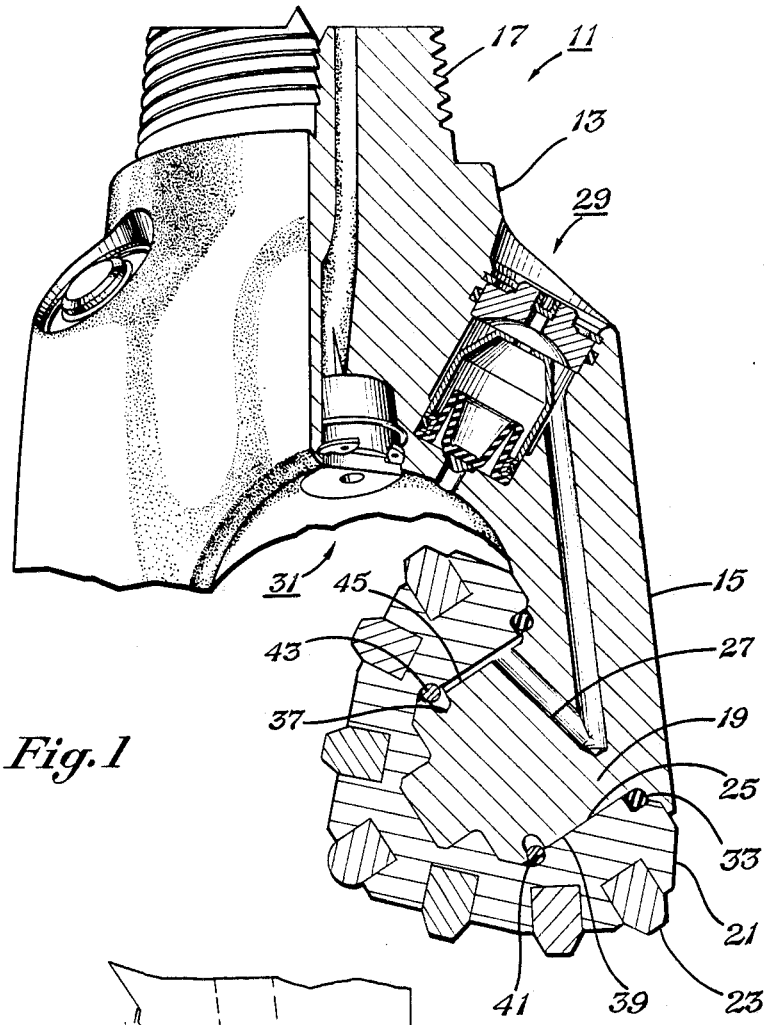
FIG. 1 is a side, perspective view of an earth boring drill bit which receives the treatment of the invention, partly in section and partly broken away.

Portions of an earth boring drill bit 11 are shown in FIG. 1, including a body 13 formed of three head sections 15 that are typically joined by a welding process. Threads 17 are formed on the top of body 13 for connection to a conventional drill string (not shown). Each head section 15 has a cantilevered shaft or bearing pin 19 having its unsupported end oriented inward and downwardly. A generally conically shaped cutter 21 is rotatably mounted on each bearing pin 19. Cutter 21 has earth disintegrating teeth 23 on its exterior and a central opening or bearing recess 25 in its interior for mounting on the bearing pin 19. Friction bearing means formed on the bearing pin 19 and cutter bearing recess 25 are connected with lubricant passage 27. A pressure compensator 29 and associated passages constitute a lubricant reservoir that limits the pressure differential between the lubricant and the ambient fluid which surrounds the bit after flowing through the nozzle means 31.

Figure 2:
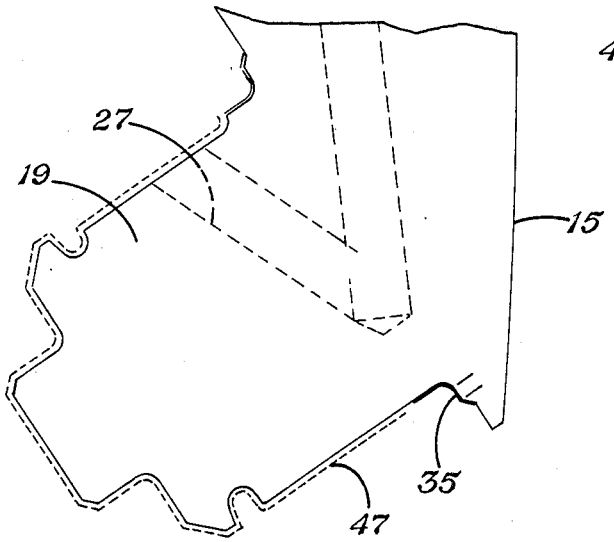
FIG. 2 is an isolated, schematic view of the pin of the bit of FIG. 1, showing the treatment regions.

An O-ring seal 33 is located between each bearing pin 19 and cutter 21 at the base of the bearing pin in a seal region (shown by darkened area in FIG. 2). The O-ring 33 and seal region 35 at the base of the bearing pin 19 prevent egress of lubricant and ingress of bore hole fluid.

An annular assembly groove 37 is formed on the cylindrical surface 39 of the bearing pin 19. A registering retainer groove 41 is formed in the bearing recess 25 of cutter 21. Grooves 37 and 41 are appropriately located so that they register to define an irregularly shaped annular cavity in which is located a snap ring 43. Snap ring 43 preferably has a circular cross-section and is formed of a resilient metal. The ring 47 contains a gap at one circumferential location, so that its annular diameter may be compressed or expanded and also so that lubricant may flow past the ring.

In operation, the most normal drilling condition produces upward and outward thrust on the cutter 21 and on bearing pin 19 as shown in FIG. 1. This results in a "pressure side" (generally at 39) on one side of the seal region 35 and an opposite gap or non-pressure side (indicated generally at 45).

FIG. 2 is a simplified schematic of the pin 19 showing the seal region 35 which receives O-ring seal 33 by darkened lines. Present heat treatments of the general bearing portion of the rock bit are carried out by carburizing and then boronizing the bearing pin. Thus, the prior art technique calls for carburizing, and thereafter boronizing, both the seal region 35 and the remaining area of the pin 47. This area 47 will sometimes be referred to as the "primary friction bearing region of the pin." The present invention is the discovery that wear on the general bearing of a rock bit head section can be prevented by applying a surface hardening treatment, such as a carburizing treatment, to the seal region 35 of the bearing pin while simultaneously boronizing only the remaining area 47 of the pin 19.

While carburizing is the preferred surface treatment technique shown in the example which follows, it should be understood that any surface treatment can be utilized which can be accomplished by the use of a solid packing mixture which can be packed around the bearing pin. The preferred technique, in addition to providing surface hardness, provides improved chemical properties to the metal surface such as resistance to oxidation and chloride pitting. Thus, the surface hardening technique utilized can be selected from the group consisting of carburizing, siliconizing, nitriding, aluminizing (or calorizing) and other "pack" surface hardening techniques. Combinations of these treatments can also be used advantageously.

Where the surface treatment selected for the seal region is carburization, the preferred technique is pack carburizing, a well known technique described on pages 114–118 of Vol. 2 of the 8th Edition of the Metals Handbook, "Heat Treating, Cleaning and Finishing" (1964, American Society for Metals). An example of a pack carburizing of a rock bit head section made of A.I.S.I. 4815 Steel is as follows:

Carburizing compound (packed around the surface to be carburized): charcoal, (16 to 80 mesh size), energized with about 8–15% by weight of potassium carbonate. Optionally, this carburizing compound may be mixed with a relatively inert binder material. The inert binder material can be one of the various organic polymers known as rubbers or resins. It can also be one of the various inert polymers based upon silicon or it can be from among other inorganic compounds which are commonly used as binders, such as sodium silicate. Such binders facilitate the forming of the powdery carburizing mixture into solid shapes which are more readily handled during the manufacturing process. Such solid forms of carburizing mixtures can also improve the uniformity of the finished product.

Carburizing temperature: 1700 degrees F.

Carburizing time: 9 hours at 1700 degrees F.

The above technique produces a carburized case depth of about 0.065 inches with carbon content at the surface of about 1.00 percent.

The simultaneous boronizing of the remaining area 47 of the pin 19 can be performed by, for instance, the use of boronizing paint or pack boronizing. Preferably, the remaining area of 47 is pack boronized. An example of boronizing An A.I.S.I. 4815 STEEL HEAD section is as follows:

Compound: Boronizing powder is packed around the bearing surface. This powder is 90% finer than 150 mesh, has 40 to 80% $B_4C$ by weight, 0 to 60% graphite by weight, 50 to 20% by weight sodium tetroborate. Small amounts of impurities can also be present. Other oxides and salts can also be used. In lieu of boron carbide, pure boron can be utilized in about the same quantity. Many other boron containing compounds can also be used, as will be appreciated by those skilled in the art. Besides these basic constituents, other metals and compounds can be added to the mix for the purpose of imparting special properties to the boronized layer.

Figure 3:
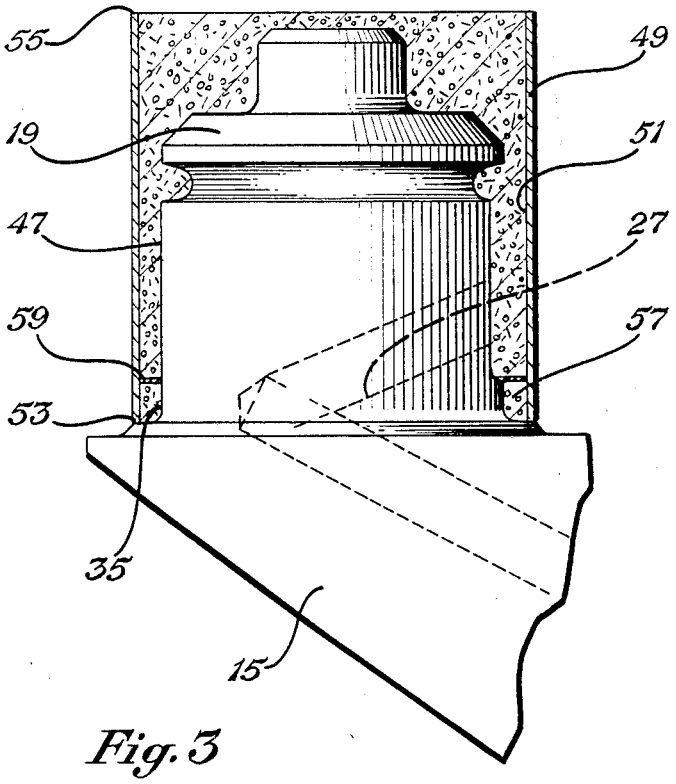
FIG. 3 is an isolated, schematic view, similar to FIG. 2, showing the container and partition used in the method of the invention.
Figure 4:
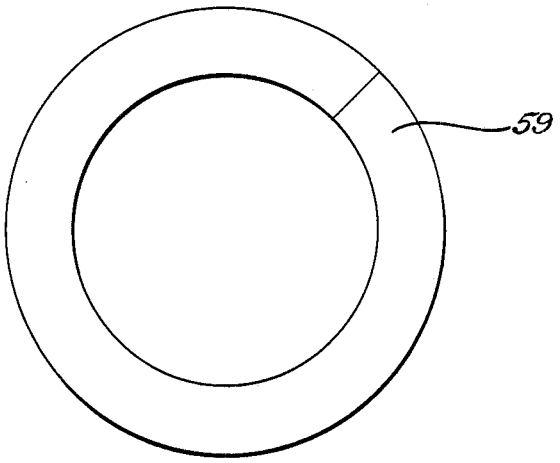
FIG. 4 is a top view of a partition used in the treatment container of the invention.

FIG. 3 shows a preferred apparatus for effecting the simultaneous carburizing and boronizing of the bearing pin 19. In order to isolate the seal region 35 from the remaining area 47 of the pin 19, a container 49 is placed over a portion of the head section so that the pin 19 extends within the interior 51 of the container. The container 49 can conveniently be a steel cylinder having open, opposed ends 53, 55. Open end 53 is placed over the pin 19 so that the head section functions as the container's bottom. A pack carburizing mixture 57, of the type previously described, is then placed into the container to a depth sufficient to cover the seal region 35. A tamping tool is used to spread the compound evenly around the base of the pin and to measure the depth of the compound. In the example shown, the carburizing compound is provided to a depth of $\frac{5}{8}$ inch plus or minus 1/16 inch. As previously described, solid forms of the carburizing mixture can also be employed.

The container interior 51 is then divided into two compartments by placing a partition, such as destructible ring 59, into the container interior on top of the carburizing mixture. Preferably, the ring 59 is made from cardboard or thin steel sheet having an inner diameter approximately equal to the bearing pin diameter and having an outer diameter approximately equal to the inner diameter of the container that is chosen. The ring is tamped into position , with care being taken to prevent the carburizing compound from leaking from under the bottom end 53 of the container 49.

The container interior 51 is then filled to the end 55 with a pack boronizing compound of the type previously described and is tamped down with a tamping tool. A steel lid (not shown) is then used to cover open end 55 and the pin and container are placed in a furnace. Preferably, the furnace temperature is in the range from about 1650 to 1800 degrees F. and the furnace time ranges from about 5 to 18 hours. Most preferably, the furnace temperature is in the range from about 1650 to 1750 degrees F. and the furnace time is about 8 to 10 hours at temperature. The resulting boronized case depth is in the range from about 0.003 to 0.008 inches and the resulting carburized case depth is in the range from about 0.070 to 0.090 inches.

The pin can then be hardened and tempered to produce a wear resistant surface in the carburized region. For instance, the pin can be hardened at a temperature of about 1500 to 1520 degrees F. in a furnace atmosphere neutral to about 0.20 percent carbon. From this temperature, the pin is quenched, as in an agitated oil, and then tempered by holding the pin at a temperature in the range from about 365 to 385 degrees F. for one hour.

An invention has been provided with several advantages. The method of manufacturing an earth boring drill bit of the invention provides a wear resistant primary friction bearing region on the pin member while providing a surface hardened seal region at the base of the bearing pin to prevent abrasive wear by the O-ring seal. The resulting bearing structure exhibits improved performance in severe conditions and the manufacturing method reduces manufacturing costs.

I claim:

1. A method of manufacturing an earth boring drill bit of the type having a bearing pin extending from a head section of the drill bit for rotatably mounting a cutter, the bearing pin having a seal region adjacent the base thereof and a primary friction bearing region extending outwardly therefrom, comprising the steps of:

isolating and applying a pack carburizing mixture to the seal region of the bearing pin;

applying a pack boronizing mixture to the remaining primary friction bearing region of the bearing pin;

carburizing the seal region of the bearing pin by heating the bearing pin in a furnace at a time and temperature to produce a carburized case of selected depth while simultaneously boronizing the remaining primary friction bearing region to produce a boronized case of selected depth by heating the entire pin in the furnace in a single step operation.

2. The method of manufacturing an earth boring drill bit of claim 1, further comprising the steps of:

subsequently quenching and then tempering the bearing pin to provide a hard, wear resistant surface in the seal region of the pin.

3. A method of manufacturing an earth boring drill bit of the type having a bearing pin extending from a head section of the drill bit for rotatably mounting a cutter, the bearing pin having a seal region adjacent the base thereof and a primary friction bearing region extending outwardly therefrom, comprising the steps of;

placing a container over a portion of the head section so that the pin extends within the interior of the container and so that the head section functions as the container's bottom;

placing a pack, surface hardening mixture into the container to a depth sufficient to cover the seal region of the pin, the pack, surface hardening mixture being selected from the group consisting of carbon rich particulate materials, silicon rich particulate materials, aluminum rich particulate materials and nitride rich particulate materials;

isolating the seal region by dividing the container into two compartments by placing a partition into the container interior on top of the selected pack, surface hardening mixture;

placing a pack boronizing mixture into the container to a depth sufficient to cover the friction bearing region of the pin;

covering the container; and surface hardening the seal region of the bearing pin to produce a case of selected depth while simultaneously boronizing the remaining primary friction bearing region of the bearing pin to produce a boronized case of selected depth by placing the container into a furnace for a time and at a temperature sufficient to produce a pin having a surface hardened seal region and a boronized friction bearing region.

4. A method of manufacturing an earth boring drill bit of the type having a bearing pin extending from a head section of the drill bit for rotatably mounting a cutter, the bearing pin having a seal region adjacent the base thereof and a primary friction bearing region extending outwardly therefrom, comprising the steps of:

placing a container over a portion of the head section so that the pin extends within the interior of the container and so that the head section functions as the container's bottom;

placing a pack carburizing mixture into the container to a depth sufficient to cover the seal region of the pin;

isolating the seal region by dividing the container into two compartments by placing a partition into the container interior on top of the carburizing mixture;

placing a pack boronizing mixture into the container to a depth sufficient to cover the friction bearing region of the pin;

covering the container; and carburizing the seal region of the bearing pin to produce a carburized case of selected depth while simultaneously boronizing the remaining primary friction bearing region of the bearing pin to produce a boronized case of selected depth by placing the pin and container into a furnace at a temperature in the range from about 1650 to 1800 degrees F. for about 5 to 18 hours.

5. The method of manufacturing an earth boring drill bit of claim 4, wherein the furnace temperature and time are selected to provide a carburized case depth on the seal region in the range from about 0.70 to 0.90 inches and to provide a boronized case depth on the primary friction region in the range from about 0.003 to 0.006 inches.

6. The method of manufacturing an earth boring drill bit of claim 5, wherein the furnace temperature is in the range from about 1650 to 1750 degrees F. and the time in the furnace is about 8 to 10 hours.

7. The method of manufacturing an earth boring drill bit of claim 4, further comprising the steps of:

quenching the pin from a temperature of at least substantially 1390 degrees F. to produce a martensitic grain structure in the carburized region of the pin; and tempering the pin from a temperature within the range of substantially 290 degrees F. to 510 degrees F. for one hour to produce a tempered martensitic grain structure in the carburized pin region.

* * * * *